US006755070B2

(12) United States Patent
Jung

(10) Patent No.: US 6,755,070 B2
(45) Date of Patent: Jun. 29, 2004

(54) CAM-TYPE PRESS SYSTEM

(75) Inventor: Byung-No Jung, Ulsan (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/334,850

(22) Filed: Dec. 26, 2002

(65) Prior Publication Data

US 2004/0000184 A1 Jan. 1, 2004

(30) Foreign Application Priority Data

Jun. 28, 2002 (KR) ..... 10-2002-37105

(51) Int. Cl.[7] ..... B21D 5/04

(52) U.S. Cl. ..... 72/452.9; 72/313; 72/387; 72/315

(58) Field of Search ..... 72/452.9, 312, 72/313, 387

(56) References Cited

U.S. PATENT DOCUMENTS 6,196,040 B1 * 3/2001 Matsuoka ..... 72/315
6,230,536 B1 * 5/2001 Matsuoka ..... 72/313

FOREIGN PATENT DOCUMENTS

JP 58-138527 * 8/1983 ..... 72/452.9
JP 62-199231 * 9/1987 ..... 72/452.9
JP 62-296914 * 12/1987 ..... 72/452.9

* cited by examiner

*Primary Examiner*—David Jones
(74) *Attorney, Agent, or Firm*—Morgan Lewis & Bockius LLP

(57) ABSTRACT

A cam-type press system is provided which includes a cam base slidably mounted on a lower die and securing a material panel with a formation pad: cam base steel is mounted on the cam base corresponding to a height of the formation cam. The cam base steel is performs a formation process on the material panel together with a formation cam. A cam slider is mounted on the cam base through a linkage assembly such that the cam slider and the cam base are able to slide. The cam slider is linked with the operation of an operational driver. First and second return assemblies are mounted respectively within the cam base and the cam slider and contacting the lower die. The first and second return assemblies exert a biasing force to return the cam base and the cam slider, respectively, to an initial position when displaced from the initial position.

6 Claims, 2 Drawing Sheets

CAM-TYPE PRESS SYSTEM

FIELD OF THE INVENTION

The present invention relates to presses for formation of auto body panels and the like, and more particularly, to a cam-type press system.

FIELD OF THE INVENTION

Panels for vehicles are typically manufactured through multiple press formation processes. These processes are performed using a variety of press systems. One such system is a cam-type press system used for the formation of flanges on product panels such as body panels by utilizing a slanted cam structure.

While such systems are well known in the art, the design of current cam-type press systems is such that with scale up to larger sizes, processing speed is reduced. There is therefore a need for larger scale cam-type press systems capable of larger speed operation.

SUMMARY OF THE INVENTION

In a preferred embodiment of the present invention, a cam-type press system includes a cam base, a cam base steel, a cam slider, a first return assembly, and a second return assembly. The cam base is slidably mounted on the lower die, and secures the material panel together with the formation pad. The cam base steel is mounted on the cam base corresponding to a height of the formation cam, and performs a formation process on the material panel together with the formation cam. The cam slider is mounted on the cam base through a linkage assembly such that the cam slider is able to move with respect to the cam base and vice versa, the formation cam is mounted to a predetermined location of the cam slider opposing the cam base steel, and the cam slider is linked with the operation of the operational driver to realize a cam operation. The first return assembly is mounted within the cam base and contacting the lower die, and the first return assembly exerts a biasing force to return the cam base to an initial position when displaced from the initial position. The second return assembly is mounted within the cam slider and contacts the lower die, and the second return assembly exerts a biasing force to return the cam slider to an initial position when displaced from the initial position.

Preferably, the linkage assembly includes a rack gear, rotating gears, and an actuating rod. The rack gear is installed on the cam base along a direction of the desired motion of the cam slider. The rotating gears are rotatably mounted to a bottom portion of the cam slider, and the rotating gears are meshed with the rack gear of the cam base. The actuating rod is connected to the rotating gear and a side of the lower die through first and second pivot points.

It is preferable that the first return assembly comprises a spring case, a guide bar, a coil spring, and a retainer. The spring case is mounted within the cam base at a predetermined location. One end of the guide bar is mounted within the spring case, and its other end protrudes from the spring case for mounting to the side wall of the lower die. The coil spring is mounted within the spring case and into which the guide bar is inserted. The retainer is formed on an end of the guide opposite the end mounted to the side wall of the lower die, and the coil spring is interposed between an inside wall of the spring case and the retainer.

It is also preferable that the second return assembly comprises a spring case, a guide bar, a coil spring, and a retainer. The spring case is mounted within the cam slider at a predetermined location. One end of the guide bar is mounted within the spring case, and its other end protrudes from the spring case for mounting to the side wall of the lower die. The coil spring is mounted within the spring case and into which the guide bar is inserted. The retainer is formed on an end of the guide opposite the end mounted to the side wall of the lower die, and the coil spring is interposed between an inside wall of the spring case and the retainer.

In a further alternative embodiment, a cam base includes an upward extending formation pad and a horizontal track. The cam base is configured and dimensioned to carry a base steel facing the track. A cam slider is mounted on the horizontal track, the cam slider being configured and dimensioned to carry a formation cam facing the base steel. The cam slider also preferably has an opposite, inclined surface. An upper die is disposed above the cam base and is moveable towards the cam base under force. An upper pad is disposed on the upper die to operatively engage the formation pad for forming of a panel portion therebetween. A driver is disposed on the upper die with an inclined surface facing the cam slider inclined surface. The two, facing inclined surfaces engage in response to downward movement of the upper die and force a formation cam mounted on the cam slider to contact a base steel for forming of a second panel portion therebetween. Preferably, the track coprises a rack and pinion gear set with the rack mounted on the cam base. Also, the upper pad may be mounted on springs on the upper die.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
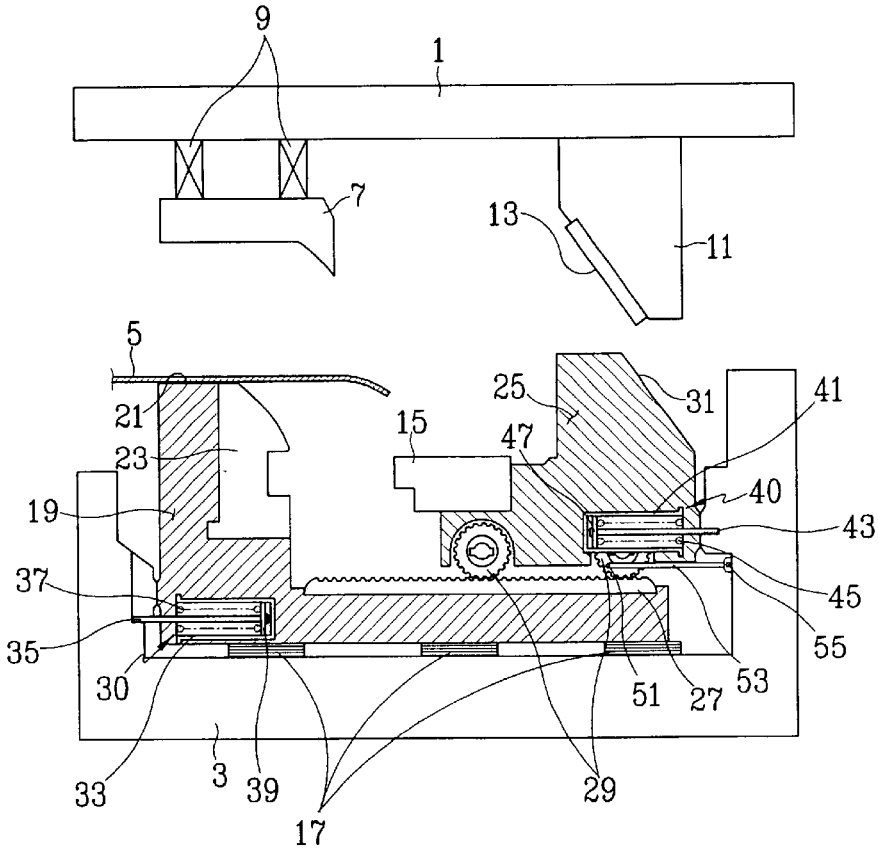
FIG. 1 is a schematic view of a cam-type press system according to a preferred embodiment of the present invention.

As shown in FIG. 1, a cam-type press system according to an embodiment of the invention includes an upper die 1 that undergoes lowering and raising operations from an upper location, and a lower die 3 positioned below the upper die 1. Lower die 3 supports a material panel 5 and elements for performing processes on the material panel 5. An upper pad 7 is mounted on one side under the upper die 1 through cushion springs 9. Mounted on the other side under the upper die 1 is an operational driver 11, which extends downwardly and includes a first cam incline surface 13 that faces generally toward the formation pad 7. In addition, a cam structure is provided on the lower die 3, in which a cam operation is realized by the lowering of the operational driver 11 such that a formation cam 15 performs a formation process to one side of the material panel 5.

Preferably, wear plates 17 are positioned on the lower die 3 to enable sliding of a cam base 19 thereon. The cam base 19 forms a pressure surface 21 at an upper portion thereof, and the pressure surface 21 and the formation pad 7 act together to secure the material panel 5. Further, a can base steel 23 is mounted on the cam base 19 at a predetermined position that corresponds to a height of the formation cam 15 such that the material panel 5 undergoes a formation process by the horizontal operation of the formation cam 15 and the cam base steel 23.

A cam slider 25, onto which the formation cam 15 is provided, is mounted on the cam base 19 through a linkage assembly such that the cam slider 25 is able to move horizontally on the cam base 19 toward the cam base steel 23 as the cam base steel 23 moves toward the cam slider 25 on the wear plates 17 positioned on the lower die 3.

The linkage assembly is realized through a rack gear 27, provided on the cam base 19 along a direction of the desired motion of the cam slider 25, and rotating gears 29, which are mounted to a rear and a front along an operational direction of the cam slider 25, meshed with the rack gear 27. An actuating rod 53 is pivotally connected to the rotating gear 29 through a first pivot point 51 at a position just below a line bisecting the center points of the rotating gears 29 and near the perimeter thereof, and to a side of the lower die 3 through a second pivot point 55.

The formation cam 15 is mounted opposing the cam base steel 23 on the cam slider 25 as described above. Formed on an opposite side of the cam slider 25 is a second cam incline 31 surface, which realizes a cam operation with the operational driver 11.

A first return assembly 30 is formed within the cam base 19 to one side of the same. The first return assembly 30 includes a spring case 33 mounted within the cam base 19, and a guide bar 35, one end of which is mounted within the spring case 33 and its other end protruding from the spring case 33 for mounting to the side wall of the lower die 3. Further, a coil spring 37 into which the guide bar 35 is inserted is mounted within the spring case 33. The coil spring 37 is interposed between an inside wall of the spring case 33 and a retainer 39 formed on the end of the guide bar 35 inserted into the spring case 33, and accordingly, the first return assembly 30 exerts a biasing force toward the side wall of the lower die 3 opposite the first return assembly 30 when the cam base 19 slides away from the same.

A second return assembly 40 is formed within the cam slider 25 on a side of the same opposite the mounting of the formation cam 15. The second return assembly 30 is structured identically to the first return assembly 30, including a spring case 43 mounted within the cam slider 25, and a guide bar 45, one end of which is mounted within the spring case 43 and its other end protruding from the spring case 43 for connection to the side wall of the lower die 3. Further, a coil spring 47 into which the guide bar 43 is inserted is mounted within the spring case 43. The coil spring 47 is interposed between an inside wall of the spring case 43 and a retainer 49 formed the end of the guide bar 45 inserted into the spring case 43. Accordingly, the second return assembly 40 exerts a biasing force toward the side wall of the lower die 3 opposite the second return assembly 40 when the cam slider 25 is positioned away from the same.

Figure 2:
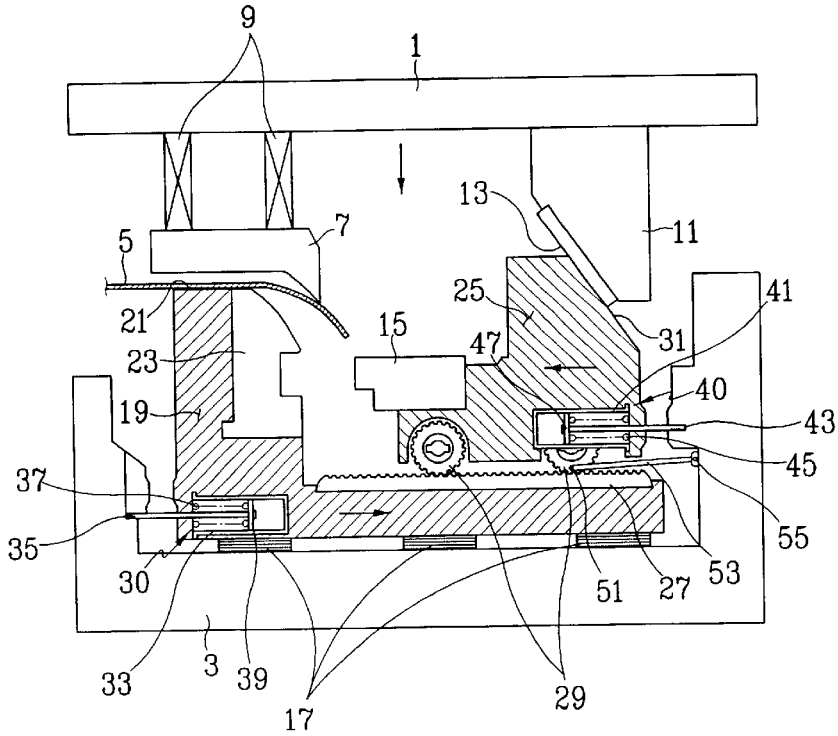
FIG. 2 is a schematic view showing the cam-type press system in a first operational state.

The application of pressure to one side of the material panel 5 to form the same using the cam-type press system will now be described. First, with reference to FIG. 1, the material panel 5 to be formed is placed on the pressure surface 21 of the cam base 19. The upper die 1 is then lowered as shown in FIG. 2 such that the formation pad 7 and the cam driver 11 are also both lowered.

As a result, the cam driver 11 realizes a cam operation with the cam slider 25 by contact of the first cam incline surface 13 with the second cam incline surface 31, causing the cam slider 25 to move horizontally in the left direction (in the drawings). At this time, because the actuating rod 53 is connecting the rotating gear to the side of the lower die 3, and the rotating gears 29 are meshed with the rack gear 27 of the cam base 19, the rotating gears 29 are rotated a circumferential distance corresponding to approximately twice the movement distance of the cam slider 25 resulting in the pulling of the cam base steel 23 toward the cam slider 25.

Figure 3:
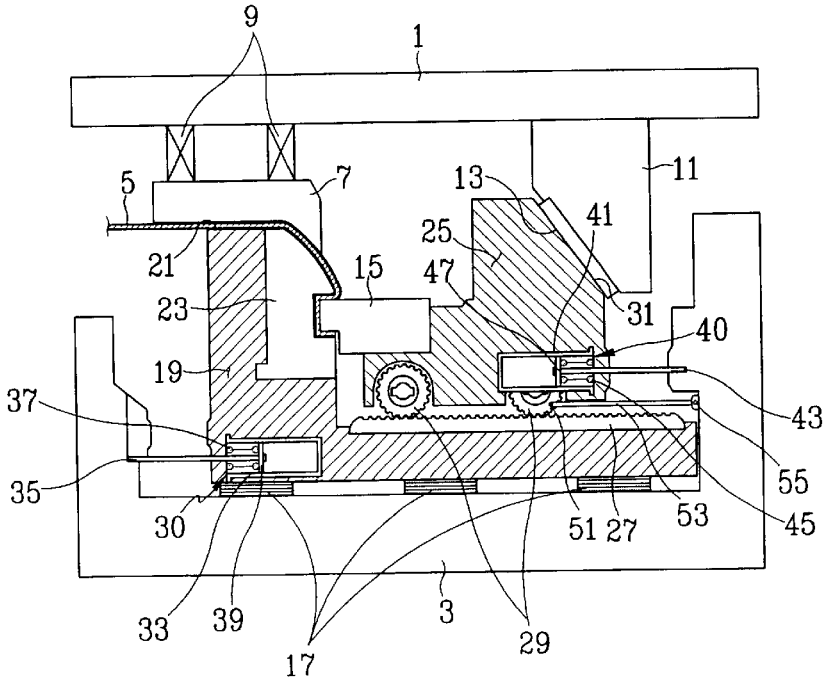
FIG. 3 is a schematic view showing the cam-type press system in a second operational state.

Referring to FIG. 3, with the continued lowering of the upper die 1, the formation pad 7 and the cam driver 11 are also further lowered. As a result, the formation pad 7 and the cam base 19 firmly secure the material panel 5, and the cam driver 11 completes its cam operation with the cam slider 25 by contact of the first cam incline surface 13 with the second cam incline surface 31 to thereby result in the cam slider 25 being displaced further to the left and the cam base being displaced further to the right in the drawing. Thus, formation cam 15 mounted on the earn slider 25 operates together with the cam base steel 23 provided on the cam base 19 such that the material panel 5 undergoes a formation process.

After the completion of the formation process, the upper die 1 is raised to thereby remove the formation pad 7 from the material panel 5 and the cam driver 11 from the cam slider 25. Therefore, by the operation of the first and second return assemblies 30 and 40, the cam base 19 and the cam slider 25 return to their initial positions as shown in FIG. 1.

In the cam-type press system of the present invention structured and operating as in the above, the driving of the cam slider and the cam base is linked through a gear connection between these two elements, thereby enabling the size of the operational driver to be reduced to minimize the operational distance of the same. This minimization in operational distance results in a reduction in operational time to decrease an overall process cycle time.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A cam-type press system for forming a panel, comprising:

an upper die and a lower die disposed for forming the panel therebetween;

a formation pad mounted on a lower side of the upper die;

an operational driver also mounted on the lower side of the upper die;

a formation cam for realizing a cam operation by the lowering operation of the operational driver on the lower die;

a cam base slidably mounted on the lower die, and securing the material panel together with the formation pad;

a cam base steel mounted on the cam base corresponding to a height of the formation cam, the cam base steel performing a formation process on the material panel together with the formation cam;

a cam slider mounted on the cam base through a linkage assembly such that the cam slider is able to move with respect to the cam base and vice versa, the formation cam being mounted at a predetermined location of the cam slider opposing the cam base steel, and the cam slider being linked with the operation of the operational driver to realize a cam operation;

a first return assembly mounted within the cam base and contacting the lower die, the first return assembly exerting a biasing force to return the cam base to an initial position when displaced from the initial position; and a second return assembly mounted within the cam slider and contacting the lower die, the second return assembly exerting a biasing force to return the cam slider to an initial position when displaced from the initial position;

wherein said linkage assembly comprises:

a rack gear installed on the cam base along a direction of desired motion of the cam slider;

rotating gears rotatably mounted to a bottom portion of the cam slider, the rotating gears being meshed with the rack gear of the cam base; and an actuating rod connected to the rotating gear and a side of the lower die through first and second pivot points.

2. The cam-type press system of claim 1, wherein the first return assembly comprises:

a spring case mounted within the cam base at a predetermined location;

a guide bar, one end of which is mounted within the spring case and its other end protruding from the spring case for mounting to a side wall of the lower die;

a coil spring mounted within the spring case and into which the guide bar is inserted; and a retainer formed on an end of the guide bar opposite the end mounted to the side wall of the lower die, the coil spring being interposed between an inside wall of the spring case and the retainer.

3. The cam-type press system of claim 1, wherein the second return assembly comprises:

a spring case mounted within the cam slider at a predetermined location;

a guide bar, one end of which is mounted within the spring case and its other end protruding from the spring case for mounting to a side wall of the lower die;

a coil spring mounted within the spring case and into which the guide bar is inserted; and a retainer formed on an end of the guide bar opposite the end mounted to the side wall of the lower die, the coil spring being interposed between an inside wall of the spring case and the retainer.

4. A press system, comprising:

a cam base including an upward extending formation pad and a horizontal track, said cam base being configured and dimensioned to carry a base steel facing said track;

a cam slider configured and dimensioned with a rotating gear mounted on the horizontal track, said cam slider configured and dimensioned to cam a formation cam facing the base steel and having an opposite, inclined surface;

an upper die disposed above the cam base and moveable towards the cam base under force;

an upper pad disposed on the upper die to operatively engage the formation pad for forming of a panel portion therebetween;

a driver disposed on the upper die with an inclined surface facing said cam slider inclined surface, wherein said inclined surfaces engage in response to downward movement of the upper die and force a formation cam mounted on the cam slider to contact a base steel for forming of a second panel portion therebetween;

wherein said cam base and said cam slider translate in opposite directions toward each other through interactions of said rotating gear and said horizontal track; and a actuating arm pivotally coupled with said rotating gear.

5. The press system of claim 4, wherein said track comprises a rack and pinion gear set, with said rack mounted on the cam base.

6. The press system of claim 4, wherein said upper pad is mounted on springs on said upper die.

* * * * *